US008708454B2

(12) United States Patent
Yokouchi

(10) Patent No.: US 8,708,454 B2
(45) Date of Patent: Apr. 29, 2014

(54) FLUID EJECTING APPARATUS

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/089,204

(22) Filed: Apr. 18, 2011

(65) Prior Publication Data

US 2011/0254895 A1 Oct. 20, 2011

(30) Foreign Application Priority Data

Apr. 20, 2010 (JP) ..... 2010-097292

(51) Int. Cl.
*B41J 2/165* (2006.01)

(52) U.S. Cl.
USPC ..... 347/31

(58) Field of Classification Search
USPC ..... 347/31, 29
See application file for complete search history.

(56) References Cited

U.S. PATENT DOCUMENTS 5,717,444 A 2/1998 Sugimoto et al.
6,616,264 B2 * 9/2003 Mitsuzawa et al. ..... 347/23
2004/0252157 A1 * 12/2004 Yamazaki et al. ..... 347/31
2007/0171254 A1 * 7/2007 Matsuoka et al. ..... 347/31
2008/0088666 A1 * 4/2008 Shindo et al. ..... 347/30
2008/0211860 A1 * 9/2008 Yamaguchi et al. ..... 347/30
2009/0201336 A1 * 8/2009 Yamamoto et al. ..... 347/36

FOREIGN PATENT DOCUMENTS

JP 02-041255 A 2/1990
JP 03-293150 A 12/1991
JP 05-063840 U 8/1993
JP 2006-142625 A 6/2006
JP 2007-125752 A 5/2007

* cited by examiner

*Primary Examiner* — Justin Seo
(74) *Attorney, Agent, or Firm* — Kilpatrick Townsend & Stockton LLP

(57) ABSTRACT

A fluid ejecting apparatus includes a fluid ejecting head and a fluid receiver. The fluid ejecting head has an ejection face in which a plurality of nozzles for ejecting fluid is formed. The ejection face is inclined with respect to a horizontal plane. The fluid receiver receives the fluid discharged from the fluid ejecting head. The fluid receiver includes a holding portion that holds an absorbing member. The absorbing member absorbs the fluid. A fluid reservoir is formed in the fluid receiver. The fluid reservoir can contain the fluid, thereby offering a fluid-retaining function that is different from the retention of the fluid due to absorption by the absorbing member.

4 Claims, 6 Drawing Sheets

FLUID EJECTING APPARATUS

CROSS REFERENCES TO RELATED APPLICATIONS

The present invention contains subject matter related to Japanese Patent Application No. 2010-097292 filed in the Japanese Patent Office on Apr. 20, 2010, the entire contents of which are incorporated herein by reference.

BACKGROUND

1. Technical Field

The present invention relates to a fluid ejecting apparatus.

2. Related Art

An ink-jet printing apparatus (hereinafter simply referred to as "printing apparatus") is well known in the art as an example of various kinds of fluid ejecting apparatuses. A fluid ejecting apparatus ejects fluid onto a target medium through the openings of nozzles formed in the ejection face of a fluid ejecting head. Some of known printing apparatuses eject ink onto a print target medium in a state in which the ejection face of a head is inclined with respect to a horizontal plane (for example, in a state in which the ejection face of a head is almost or substantially perpendicular to the horizontal plane) (for example, refer to JP-A-3-293150).

As with many printing apparatuses that are equipped with other types of heads, a printing apparatus that is equipped with such a so-called vertical-type head also performs suction operation for the following purposes, though not limited thereto: in order to prevent the openings of nozzles from becoming clogged due to an increase in the viscosity of ink, in order to discharge, from the head, air bubbles formed inside the head due to the entering of air, and/or in order to discharge dust or other foreign particles from the head. Specifically, ink with increased viscosity, etc., is forcibly sucked out of the head for the above purposes.

When suction operation is performed, a cap member is set at a position where the ejection face of a head and the cap member face each other. Since the opening (a region that is used to seal the ejection face) of the cap member is oriented sideways, suction operation is performed with an ink-absorbing member fitted in the cap member in order to prevent ink from spilling during the process of the operation.

However, the above structure has the following disadvantages. Ink absorbed by the ink-absorbing member seeps to the bottom. Therefore, there is a risk that the ink will flow to the opening of the cap member. If the ink flows to the opening of the cap member, there is a risk that the ink will stick to the ejection face of the head when capping operation, etc. is performed.

SUMMARY

An advantage of some aspects of the invention is to provide a fluid ejecting apparatus that can prevent the deterioration of discharging environment.

A fluid ejecting apparatus according to a first aspect of the invention includes a fluid ejecting head and a fluid receiver. The fluid ejecting head has an ejection face in which a plurality of nozzles for ejecting fluid is formed. The ejection face is in an inclined state, that is, inclined with respect to a horizontal plane. The fluid receiver receives the fluid discharged from the fluid ejecting head. The fluid receiver includes a holding portion and a fluid reservoir. The holding portion holds an absorbing member that absorbs the fluid discharged from the fluid ejecting head. The fluid reservoir has a space for containing the fluid discharged from the fluid ejecting head.

In the above structure of a fluid ejecting apparatus according to the first aspect of the invention, the fluid reservoir, which can contain the fluid, thereby offering a fluid-retaining function that is different from the retention of the fluid due to absorption by the absorbing member, is formed in the fluid receiver, which has a function of receiving the fluid. Therefore, it is possible to make the fluid received by the fluid receiver enter the fluid reservoir and make it form a pool in the fluid reservoir. By this means, it is possible to prevent the fluid received by the fluid receiver from leaking to the outside of the fluid receiver. Thus, it is possible to prevent the deterioration of discharging environment.

In a fluid ejecting apparatus according to the first aspect of the invention, it is preferable that the space of the fluid reservoir should be located at a lower position in a direction of gravitational force with respect to the absorbing member and should adjoin the absorbing member.

Since the space of the fluid reservoir is located at a lower position in a direction of gravitational force with respect to the absorbing member and adjoins the absorbing member in the preferred structure described above, it is possible to make a part of the fluid absorbed by the absorbing member enter the fluid reservoir by gravity and make it form a pool in the fluid reservoir. Thus, it is possible to prevent the fluid from leaking to the outside of the fluid receiver by gravity with greater reliability.

It is preferable that a fluid ejecting apparatus according to the first aspect of the invention should further include a sucking section that applies a suction force to the fluid receiver, wherein the sucking section is connected to the fluid reservoir.

In the preferred structure described above, a fluid ejecting apparatus according to the first aspect of the invention furthers include a sucking section that applies a suction force to the fluid receiver, wherein the sucking section is connected to the fluid reservoir. Therefore, it is possible to suck out a pool of the fluid in the fluid reservoir efficiently.

In a fluid ejecting apparatus according to the first aspect of the invention, it is preferable that the fluid receiver should have an air communication port that is formed at an upper position in the direction of gravitational force; and the air communication port should be configured to be able to make the absorbing member and the fluid reservoir in communication with the outside therethrough.

With such a preferred structure, since the fluid receiver has an air communication port through which it is possible to make the absorbing member and the fluid reservoir in communication with the outside, it is possible to relieve the state of negative pressure applied to the fluid receiver due to suction. In addition, since the air communication port is formed at an upper position in the direction of gravitational force, it is possible to avoid the fluid from flowing to the air communication port. Moreover, since the air communication port, the absorbing member, and the fluid reservoir are arranged along the direction of gravitational force, it is possible to drain the fluid by means of the sucking section with greater reliability.

Preferably, the above fluid ejecting apparatus is characterized in that the fluid receiver includes a cap member that has a bottom portion and a rim portion, the holding portion includes the bottom portion and the rim portion, and the fluid reservoir is formed at a partial region of the bottom portion and the rim portion included in the holding portion.

With such a preferred structure, since the fluid reservoir is formed at a partial region of the bottom portion and the rim portion included in the holding portion, it is possible to make it easier for the fluid absorbed by the absorbing member to flow into the fluid reservoir.

In a fluid ejecting apparatus according to the first aspect of the invention, it is preferable that the inclined state should include a first state, which is a state in which the ejection face is perpendicular to the horizontal plane.

Even in a structure in which the fluid received by the fluid receiver is susceptible to leakage to the outside of the fluid receiver because the ejection face is in the first state, which is a state in which the ejection face is perpendicular to the horizontal plane, the leakage of the fluid can be prevented. Thus, it is possible to prevent the deterioration of discharging environment.

In a fluid ejecting apparatus according to the first aspect of the invention, it is preferable that the inclined state should include a second state, which is a state in which the ejection face is inclined with respect to the horizontal plane with a predetermined angle formed by the ejection face and the horizontal plane.

Even in a structure in which the fluid received by the fluid receiver is susceptible to leakage to the outside of the fluid receiver because the ejection face is in the second state, which is a state in which the ejection face is inclined with respect to the horizontal plane with a predetermined angle formed by the ejection face and the horizontal plane, the leakage of the fluid can be prevented. Thus, it is possible to prevent the deterioration of discharging environment.

Preferably, the above fluid ejecting apparatus is characterized in that the fluid receiver is configured to be able to cover the ejection face.

With such a preferred structure, even when the ejection face is covered by the fluid receiver, it is possible to prevent the fluid from sticking to the ejection face.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
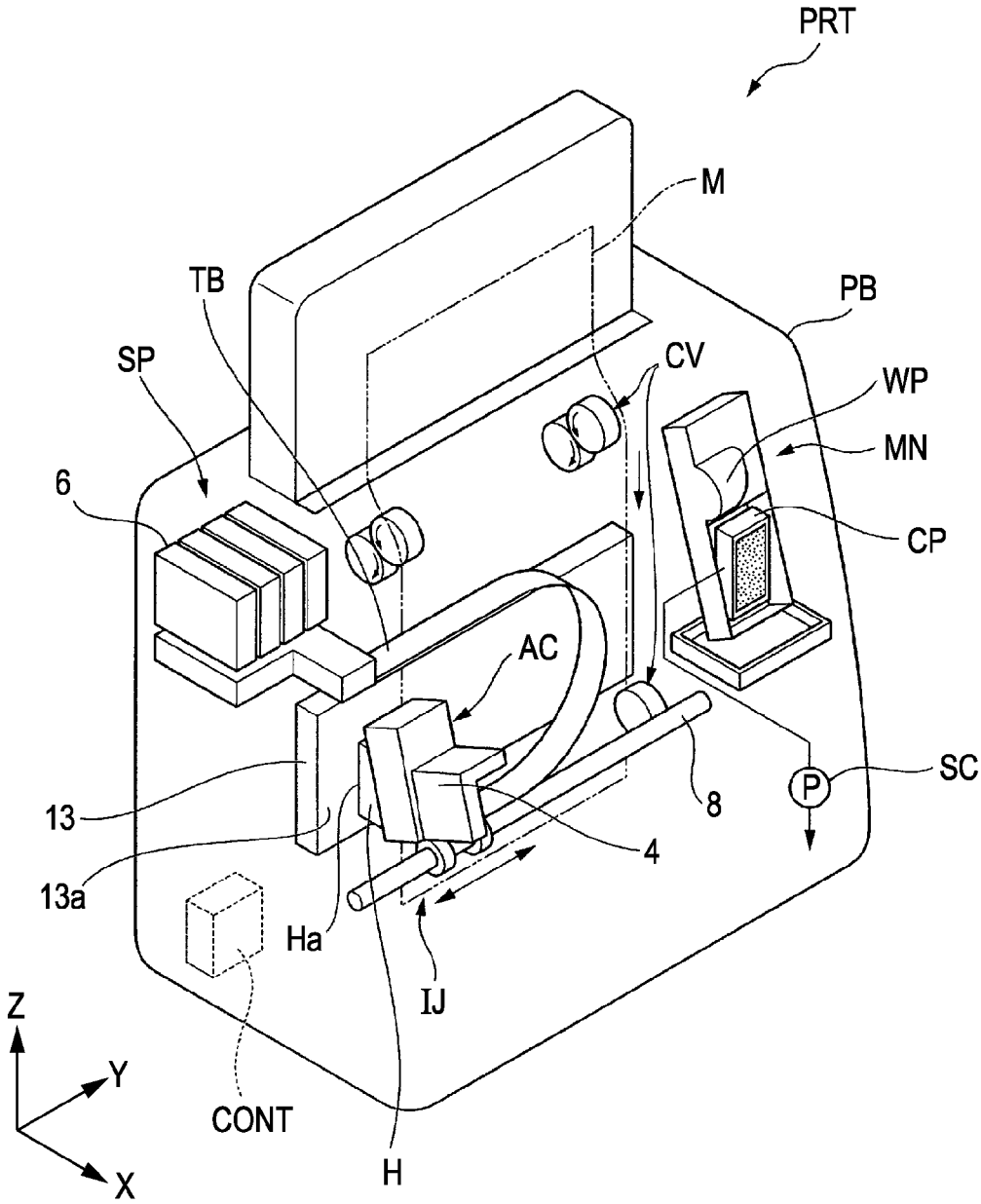
FIG. 1 is a diagram that schematically illustrates an example of the structure of a printing apparatus according to an exemplary embodiment of the invention.

With reference to the accompanying drawings, an exemplary embodiment of the present invention will now be explained. FIG. 1 is a diagram that schematically illustrates an example of the structure of a printing apparatus PRT (liquid ejecting apparatus) according to the present embodiment of the invention. In the present embodiment of the invention, an ink-jet printer is taken as an example of the printing apparatus PRT.

The printing apparatus PRT illustrated in FIG. 1 is a machine that prints an image on a sheet-like target medium M such as a sheet of paper, a plastic sheet, or the like. The printing apparatus PRT includes a printer body (casing) PB, an ink-jet mechanism IJ, which ejects ink onto the medium M, an ink-supplying mechanism SP, which supplies ink to the ink-jet mechanism IJ, a transportation mechanism CV, which transports the medium M, a maintenance mechanism MN, which performs maintenance on the ink-jet mechanism IJ, and a control unit CONT, which controls these mechanisms.

An XYZ orthogonal coordinate system is set for purposes of illustration. In the following description, positional relationships between components, mechanisms, and the like will be explained with reference to the XYZ orthogonal coordinate system. In the present embodiment of the invention, a given direction on a horizontal plane is defined as the X direction. The direction that is orthogonal to the X direction on the horizontal plane is defined as the Y direction. The direction that is perpendicular to the horizontal plane is defined as the Z direction. The direction of rotation around the X axis is defined as the θX direction. The direction of rotation around the Y axis is defined as the θY direction. The direction of rotation around the Z axis is defined as the θZ direction.

The long-side direction of the printer body PB is taken as the Y direction. The ink-jet mechanism IJ, the ink-supplying mechanism SP, the transportation mechanism CV, the maintenance mechanism MN, and the control unit CONT mentioned above are mounted inside the printer body PB. A platen 13 is provided inside the printer body 13. The platen 13 is a supporting member that supports the medium M. The platen 13 has a flat surface 13*a*, which is oriented in the +X direction. The flat surface 13*a* is used as a surface for supporting the medium M.

The transportation mechanism CV includes a transportation roller, a motor that drives the transportation roller to rotate, and the like. The transportation mechanism CV feeds the medium M into the printer body PB from the outside of the printer body PB, specifically, the +Z side. The transportation mechanism CV ejects the medium M to the outside of the printer body PB through the +X side, the −X side, or +Z side of the printer body PB. The transportation mechanism CV transports the medium M inside the printer body PB in such a way that the medium M passes over the surface of the platen 13. The control unit CONT controls the timing of the transportation of the medium M by the transportation mechanism CV, the amount of transportation thereof, and the like.

The ink-jet mechanism IJ includes a head H, which ejects ink, and a head movement mechanism AC, which moves the head H while supporting it. The head H ejects ink toward the medium M transported onto the surface of the platen 13. The head H has an ejection face Ha from which ink is ejected. The head H is mounted in such a way that the ejection face Ha is in an inclined state, that is, inclined with respect to the horizontal plane (X-Y plane). Herein, the inclined state includes a first state, which is, for example, a state in which the ejection face Ha is "perpendicular" to the horizontal plane. The term "perpendicular" herein refers to a state in which the angle formed by the ejection face Ha with the horizontal plane falls within a range from 85° inclusive to 95° inclusive. In addition, the inclined state includes a second state, which is, for example, a state in which the angle formed by the ejection face Ha with the horizontal plane is larger than 40° but smaller than 85°. In the present embodiment of the invention, the angular range mentioned first, in which the ejection face Ha is in the first state (perpendicular to the horizontal plane), is taken as an example.

The ejection face Ha is oriented in the −X direction. Therefore, the ejection face Ha is oriented to face the medium-supporting surface 13*a* of the platen 13. As explained above, in the present embodiment of the invention, the ejection face Ha of the head H is oriented in the −X direction, which means that the ejection face Ha is perpendicular to the horizontal plane.

The head movement mechanism AC includes a carriage 4. The head H is fixed to the carriage 4. The carriage 4 is slidably in contact with a guide shaft 8, which extends in the long-side direction of the printer body PB (the Y direction). Besides the carriage 4, the head movement mechanism AC includes a pulse motor, a driving pulley, an idle pulley, a timing belt, and the like. Note that these components except for the carriage 4 are not illustrated in the drawing. The carriage 4 is attached to the timing belt. The carriage 4 is configured to be able to move in the Y direction as the timing belt runs. The guide shaft 8 guides the movement of the carriage 4 when it moves in the Y direction.

The ink-supplying mechanism SP supplies ink to the head H. A plurality of ink cartridges 6 is housed in the ink-supplying mechanism SP. The printing apparatus PRT according to the present embodiment of the invention has a structure in which the plurality of ink cartridges 6 is housed at positions different from the position of the head H (off-carriage type). The ink-supplying mechanism SP includes an ink-supplying tube TB for connection between the head H and the ink cartridges 6. In addition, the ink-supplying mechanism SP includes a pump mechanism, which is not illustrated in the drawing, for supplying ink contained in the ink cartridges 6 to the head H through the ink-supplying tube TB. The maintenance mechanism MN is provided at the home position of the head H. The home position is located outside an area where an image is printed on the medium M. In the present embodiment of the invention, the home position is set at a +Y-side area with respect to the platen 13. The home position is a position at which the head H stays when the printing apparatus PRT is powered off and when printing operation is not performed for a long period of time, though not limited thereto.

The maintenance mechanism MN includes a capping mechanism CP, which is used as a cap for covering the ejection face Ha of the head H, a wiping mechanism WP, which is used for wiping the ejection face Ha, and the like. A suction mechanism SC such as a suction pump is connected to the capping mechanism CP. The capping mechanism CP is configured to be able to apply a suction force, which is generated by the suction mechanism SC, to a space enclosed by the ejection face Ha of the head H and the capping mechanism CP itself in a capped state, that is, in a state in which the ejection face Ha is covered by the capping mechanism CP. The capping mechanism CP is oriented toward the ejection face Ha of the head H (in the +X direction). Waste ink discharged into the maintenance mechanism MN from the head H is collected into a waste ink collection mechanism (not shown).

Figure 2:
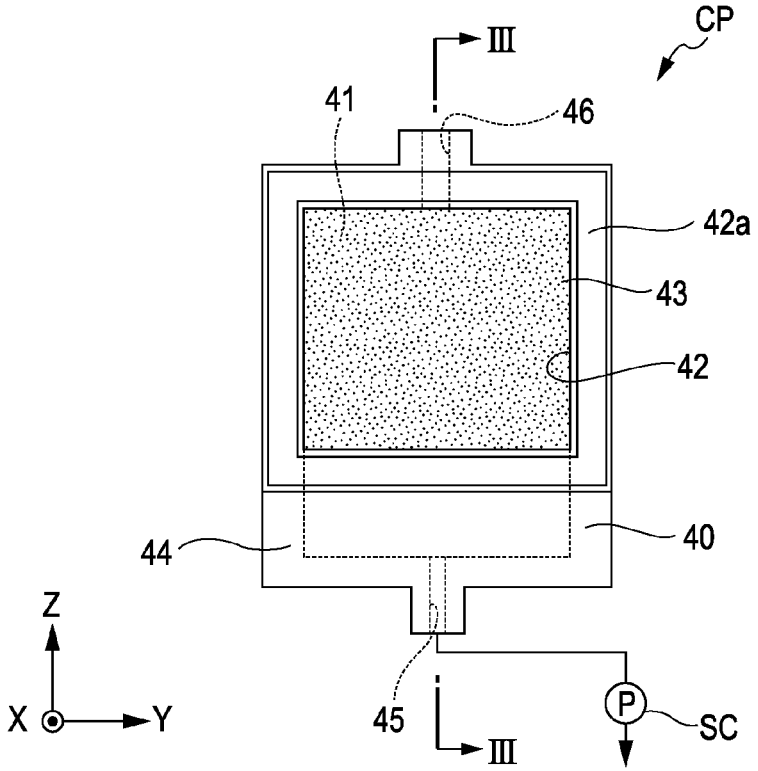
FIG. 2 is a diagram that schematically illustrates an example of the structure of a capping mechanism according to an exemplary embodiment of the invention.
Figure 3:
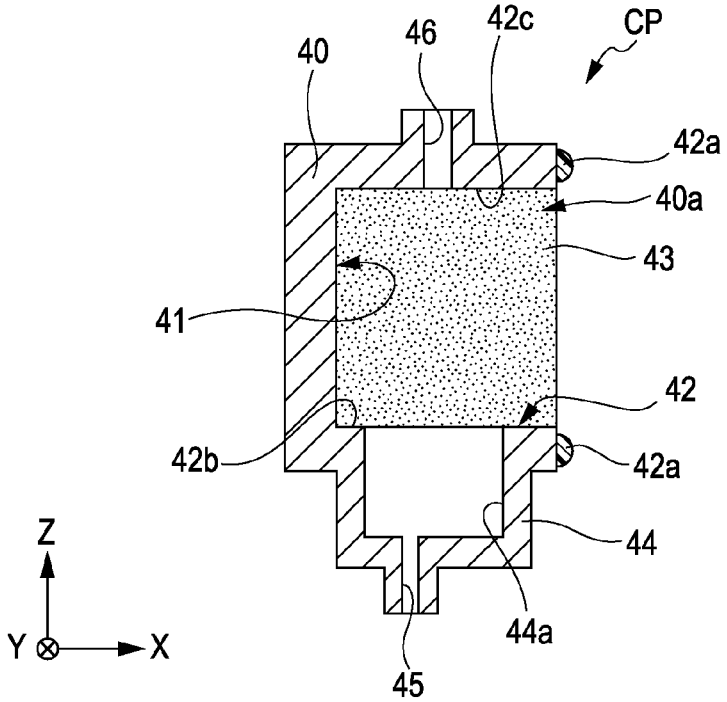
FIG. 3 is a diagram that schematically illustrates an example of the structure of a capping mechanism according to an exemplary embodiment of the invention.

FIG. 2 is a diagram that schematically illustrates an example of the structure of the capping mechanism CP. FIG. 3 is a sectional view taken along the line III-III of FIG. 2. As illustrated in FIGS. 2 and 3, the capping mechanism CP includes a cap member 40. The cap member 40 has a bottom portion 41 and a rim portion 42. The cap member 40 has a rectangular shape as viewed from the +X side. The bottom portion 41 has a flat bottom surface. The bottom surface is oriented in the +X direction. The rim portion 42 is formed at the edges of the bottom portion 41. The rim portion 42 encloses the rectangular area as viewed from the +X side. The rim portion 42 is formed as peripheral walls around the rectangular face of the bottom portion 41. A seal member 42*a* is provided on the +X-side face of the rim portion 42. The seal member 42*a* is made of a material that can be elastically deformed. For example, it is made of resin. When it is in a capping state, the seal member 42*a* is in contact with the edges of the ejection face Ha of the head H. By this means, it is possible to hermetically seal the ejection face Ha with the seal member 42*a*.

An ink-absorbing member 43 is provided on the face part of the bottom portion 41, which is enclosed by the rim portion 42. The part on which the ink-absorbing member 43 is provided is hereinafter referred to as absorber-embedment portion 40*a*. The ink-absorbing member 43 is made of a porous material such as sponge. The ink-absorbing member 43 is fitted in the absorber-embedment portion 40*a* without leaving any space. The ink-absorbing member 43 is fixed thereat by the bottom portion 41 and the rim portion 42. That is, besides their primary functions, the bottom portion 41 and the rim portion 42 serve as a holding portion, which has a function of holding the ink-absorbing member 43.

An ink reservoir 44, which is an example of a fluid reservoir, is formed at a first wall 42*b*, which is one of the four walls that make up the rim portion 42. Specifically, the first wall 42*b* is one that is located at the lowest position (−Z side) as viewed in the direction of gravitational force. The ink reservoir 44 is projected to the −Z side with respect to the first wall 42*b*. The ink reservoir 44 has a recess 44*a* that can contain ink. The recess 44*a* is formed at a position where it overlaps the ink-absorbing member 43. The recess 44*a* is in communication with the absorber-embedment portion 40*a*. Ink absorbed by the ink-absorbing member 43 transudes into the recess 44*a* to form a pool therein, that is, stay and accumulate therein.

A suction port 45 is provided in a wall of the ink reservoir 44. The suction port 45 has a through hole. The inside of the recess 44*a* is in communication with the outside thereof through this hole. The suction mechanism SC is connected to the suction port 45. Therefore, the suction mechanism SC is configured to be able to apply a suction force to the inside of the recess 44*a*. When the suction mechanism SC applies a suction force to the inside of the recess 44*a*, the force is exerted on the absorber-embedment portion 40*a*, which is in communication with the recess 44*a*. As described above, it is possible to exert a suction force on the absorber-embedment portion 40*a* as well as the inside of the recess 44*a* by performing suction operation by means of the suction mechanism SC.

An air communication port 46 is provided in a second wall 42*c*. The second wall 42*c* is another one of the four walls that make up the rim portion 42, more specifically, one that is located at the +Z side. The air communication port 46 has a through hole. The absorber-embedment portion 40*a* is in communication with the outside of the cap member 40 through this hole. An electromagnetic valve that is not illustrated in the drawing, etc., is provided in the air communication port 46. The electromagnetic valve opens and closes in accordance with the control of the control unit CONT.

Figure 5:
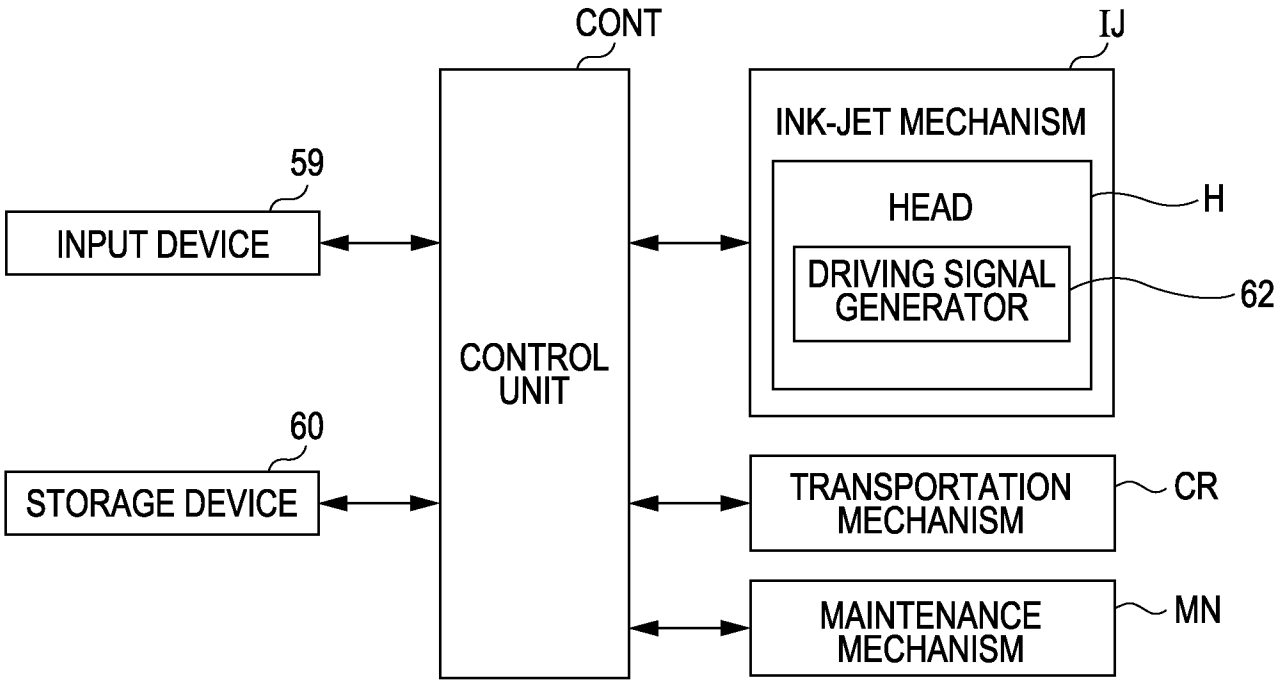
FIG. 5 is a block diagram that schematically illustrates an example of the electric configuration of a printing apparatus according to an exemplary embodiment of the invention.

FIG. 5 is a block diagram that schematically illustrates an example of the electric configuration of the printing apparatus PRT. The printing apparatus PRT according to the present embodiment of the invention includes the control unit CONT, which controls the entire operation thereof. An input device 59 and a storage device 60 are connected to the control unit CONT. The input device 59 is used for inputting various kinds of information related to the operation of the printing apparatus PRT. Various kinds of information related to the operation of the printing apparatus PRT are stored in the storage device 60.

The components of the printing apparatus PRT such as the ink-jet mechanism IJ, the transportation mechanism CV, the maintenance mechanism MN, and the like are connected to the control unit CONT. The printing apparatus PRT is provided with a driving signal generator 62, which generates a driving signal that is to be inputted into the head H. The driving signal generator 62 is connected to the control unit CONT.

Data that indicates the amount of a change in the voltage value of a discharging pulse that is to be inputted into the head H is inputted into the driving signal generator 62. In addition to the data, a timing signal that determines the timing of the change in the voltage value of the discharging pulse is inputted into the driving signal generator 62. On the basis of the input of the data and the timing signal, the driving signal generator 62 generates a driving signal such as a discharging pulse and the like.

Next, the operation of the printing apparatus PRT having the above configuration will now be explained. To perform printing operation by means of the head H, the control unit CONT causes the transportation mechanism CV to position the print target medium M on the medium-supporting surface 13*a* of the platen 13. After the positioning of the print target medium M, the control unit CONT inputs a driving signal into the head H on the basis of image data for an image that is to be printed. As a result of the above operation, ink is ejected in the −X direction from nozzles NZ that are formed in the ejection face Ha of the head H. By this means, a desired image is formed on the print target medium M.

To perform maintenance on the head H, the control unit CONT carries out control for capping operation and, in addition, for the operation of discharging ink into the cap member 40 and draining the ink that has formed a pool in the cap member 40 (cleaning). To perform capping operation, the control unit CONT causes the head H to move to the home position where the head H and the cap member 40 face each other.

Figure 4:
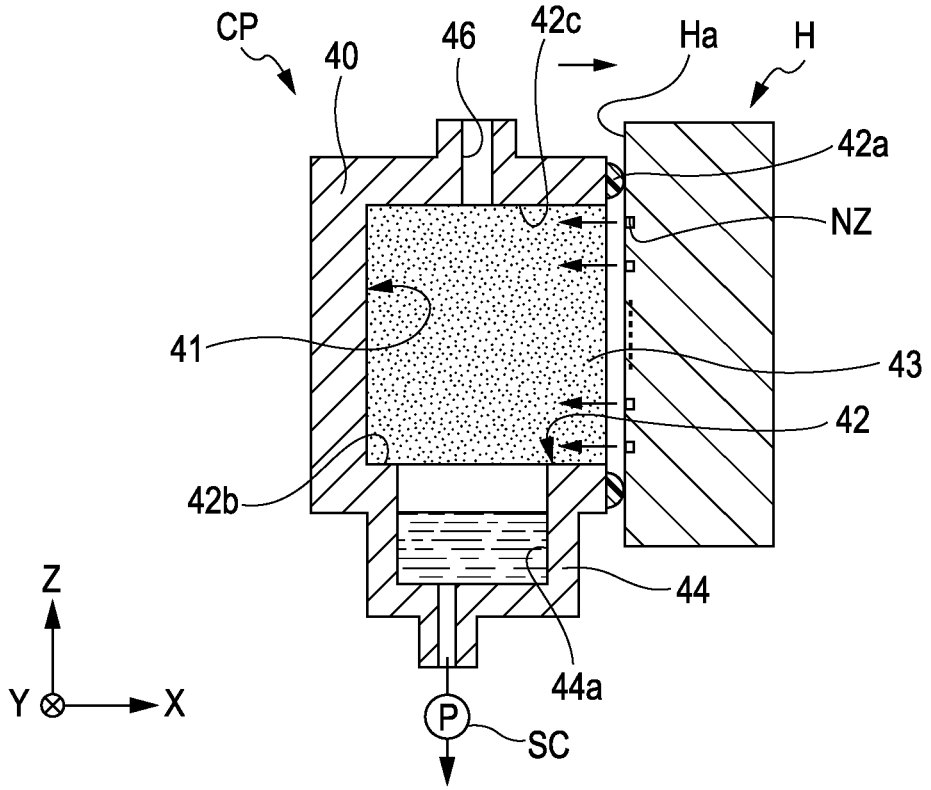
FIG. 4 is a diagram that schematically illustrates an example of capping operation according to an exemplary embodiment of the invention.

In this state, the control unit CONT carries out control for adjusting the position and orientation of the cap member 40 in such a way as to parallelize the cap member 40 with the ejection face Ha of the head H. At the same time, the control unit CONT causes a cam member that is not illustrated in the drawing to rotate, thereby pressing the cap member 40 against the head H. As a result of the above operation, as illustrated in FIG. 4, a space between the cap member 40 and the head H is put into a hermetically-sealed state.

The control unit CONT carries out control for, for example, actuating the suction mechanism SC in a state in which the air communication port 46 is closed after bringing the cap member 40 into contact with the head H. Due to a suction force applied by the suction mechanism SC, the internal pressure of the recess 44*a*, which is in communication with the suction mechanism SC, and the absorber-embedment portion 40*a*, which is in communication with the recess 44*a*, turns negative. Because of the negative pressure, ink is sucked out of (discharged from) each of the nozzles NZ of the head H in the −X direction. By this means, the viscosity of ink in the nozzles NZ is kept at an appropriate level. The ink-absorbing member 43 of the cap member 40 absorbs the ink sucked out of (discharged from) each of the nozzles NZ.

Figure 6:
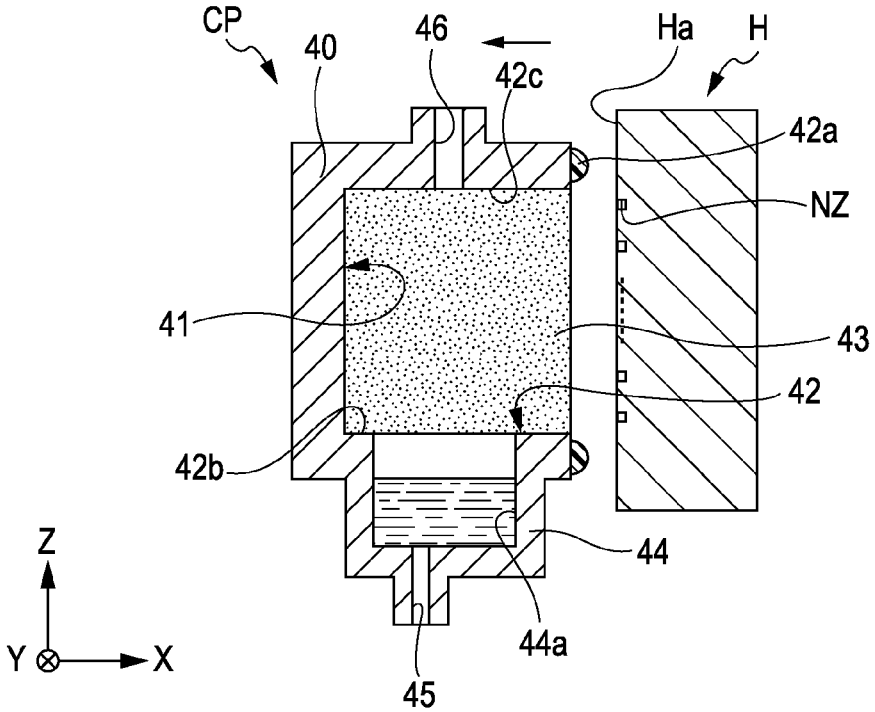
FIG. 6 is a diagram that schematically illustrates an example of capping operation according to an exemplary embodiment of the invention.

After the completion of ink-sucking operation, the control unit CONT carries out control for opening the air communication port 46. Since the air communication port 46 is opened, the absorber-embedment portion 40*a* of the cap member 40 is opened to the outside, which results in relieving the state of negative pressure. After the relief of the state of negative pressure, the control unit CONT causes the suction mechanism SC to perform suction operation again in a state in which the edges of the ejection face Ha of the head H remain sealed by the seal member 42*a*. As a result of the above operation, ink that has been absorbed by the ink-absorbing member 43 is drained into the recess 44*a* and then through the suction port 45. After the draining of the ink, the control unit CONT carries out control for releasing the cap member 40 from the head H as illustrated in FIG. 6 and terminating the suction operation.

In the course of the repetition of the above series of steps over time, the ink-absorbing member 43 is often left to stand in a state in which ink remains absorbed therein. When the ink-absorbing member 43 is left to stand, the ink seeps to the −Z side of the ink-absorbing member 43 gradually. In general, ink sucked out of the nozzles NZ includes plural color-component types. Therefore, the ink that seeps down gradually is in a color-mixed state. If the ink flows to the opening of the cap member 40, which is oriented in the +X direction, there is a risk that the ink could stick to the ejection face Ha of the head H.

In contrast, since the ink reservoir 44 is formed at the first wall 42*b* of the rim portion 42 of the cap member 40, with the present embodiment of the invention, it is possible to make ink enter the ink reservoir 44 and make it form a pool in the ink reservoir 44. Therefore, it is possible to prevent ink from flowing to the opening of the cap member 40. By this means, since the sticking of ink to the ejection face Ha of the head H will not occur, it is possible to maintain good discharging environment as desired.

The technical scope of the invention is not limited to the exemplary embodiment described above. The invention can be modified in various ways within a range not departing from the gist of the invention.

Figure 7:
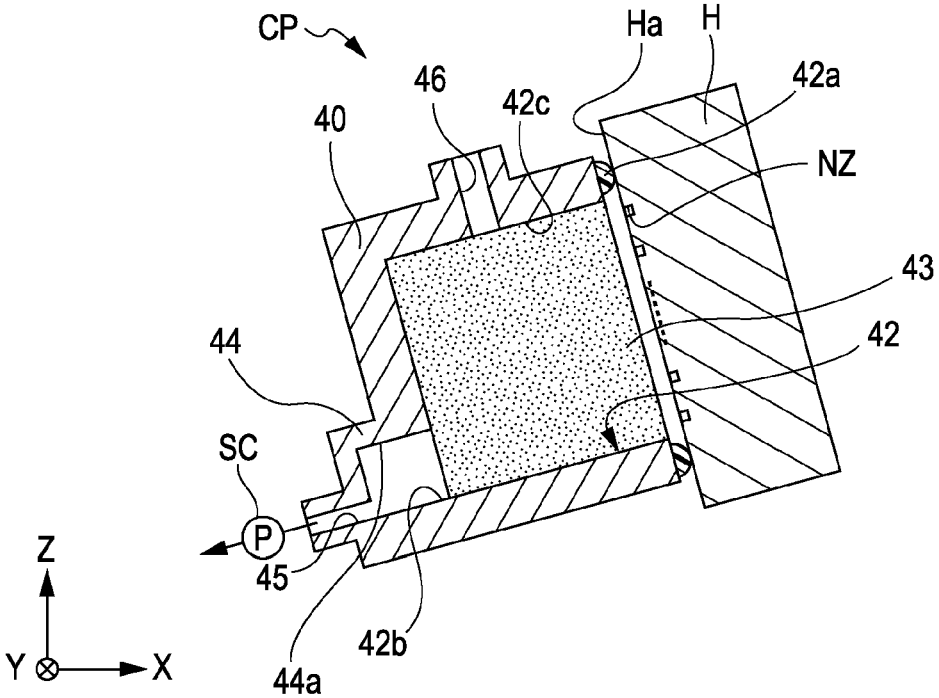
FIG. 7 is a diagram that schematically illustrates an example of the structure of a capping mechanism according to another embodiment of the invention.

In the foregoing embodiment of the invention, the first state, which is a state in which the ejection face Ha of the head H is perpendicular to the horizontal plane, is taken as an example. However, the scope of the invention is not limited to such an example. For example, as illustrated in FIG. 7, the foregoing technical concept can be explained for a structure with an inclination (with a greater inclination) in which the angle formed by the ejection face Ha with the horizontal plane is larger than 40° but smaller than 85°, which is the second state.

When the inclination of the ejection face Ha is set in the second state, the structure of the capping mechanism CP can be modified. A modified structure in which the ink reservoir 44 is formed at the bottom portion 41 is illustrated in FIG. 7. In the illustrated structure, ink absorbed by the ink-absorbing member 43 moves downward as viewed in the direction of gravitational force (to the −Z side: toward the bottom of FIG. 7) along an inclined surface of the rim portion 42 over time. Therefore, the ink flows into the ink reservoir 44, which has the recess 44*a* in which the ink can form a pool. The structure in which the ink reservoir 44 is formed at the bottom portion 41 may be adopted for the foregoing inclination state, that is, when the inclination of the ejection face Ha is set in the first state.

Figure 8:
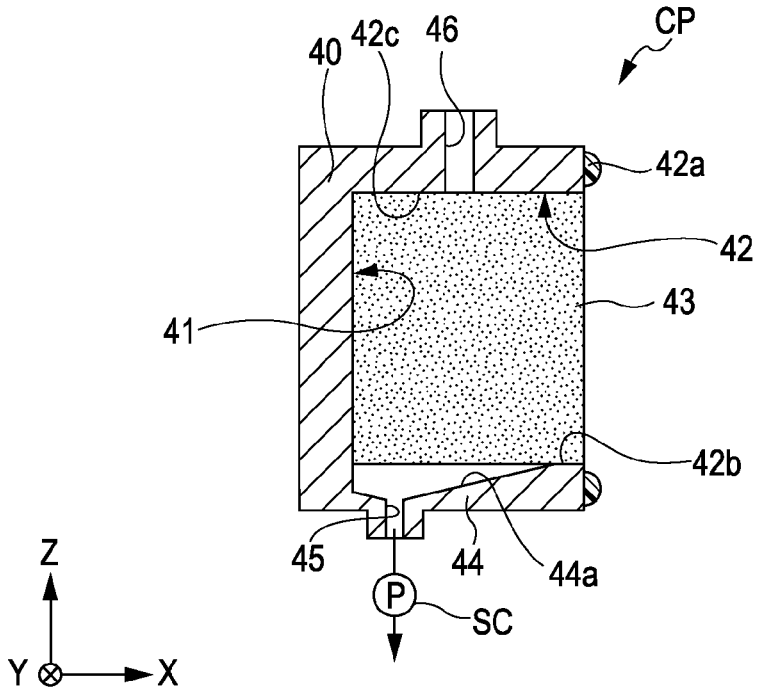
FIG. 8 is a diagram that schematically illustrates an example of the structure of a capping mechanism according to another embodiment of the invention.

In the foregoing embodiment of the invention, a structure in which the ink reservoir 44 is projected to the −Z side with respect to the first wall 42*b* is taken as an example. However, the scope of the invention is not limited to such an example. For example, as illustrated in FIG. 8, the recess 44*a* may be formed as a part of the first wall 42*b* without forming the ink reservoir 44 at the −Z side with respect to the first wall 42*b*. The recess 44*a* can contain ink even with the above modification.

Figure 9:
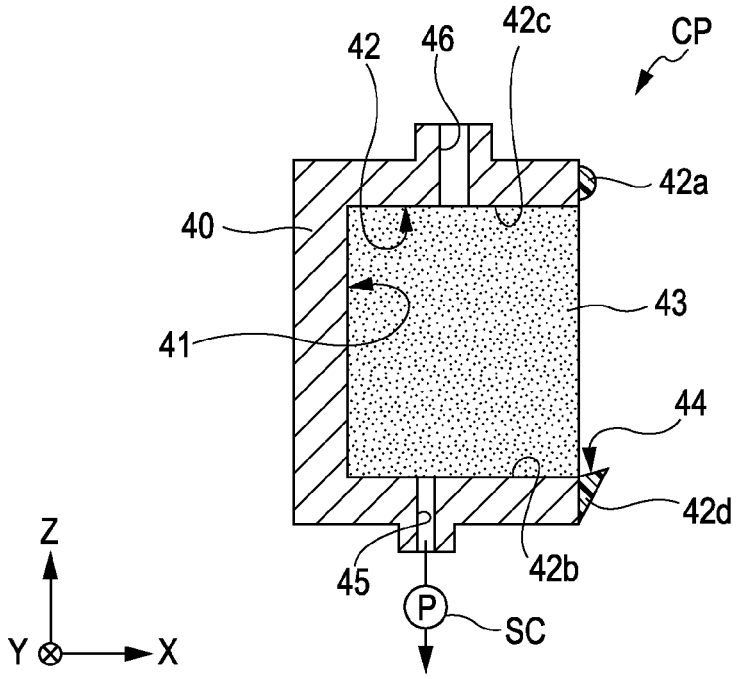
FIG. 9 is a diagram that schematically illustrates an example of the structure of a capping mechanism according to another embodiment of the invention.

In the foregoing embodiment of the invention and the above modification example, the ink reservoir 44 is formed at the rim portion 42 or the bottom portion 41. However, the scope of the invention is not limited to such an example. For example, as illustrated in FIG. 9, a −Z-side seal member 42*d* that has a part protruding in the +X (+Z) direction may be provided. In the structure illustrated in FIG. 9, the ink reservoir 44 is formed in the seal member 42*d*. In this modification example, the difference in level due to the +Z protrusion can be utilized for the function of an ink reservoir.

In the foregoing embodiment of the invention, a fluid ejecting apparatus according an aspect of the invention is embodied as an ink-jet printer. However, the scope of the invention is not limited to such an example. The invention is applicable to a variety of fluid ejecting apparatuses that eject or discharge various kinds of fluid that includes ink but not limited thereto. That is, it can be applied to various micro-drop fluid ejecting apparatuses. The micro-drop fluid ejecting apparatus is provided with a micro-drop fluid ejecting head for discharging liquid droplets whose amount is very small. Herein, a "liquid droplet" is a form or a state of liquid in the process of ejection of the liquid from a liquid ejecting apparatus. The liquid droplet encompasses, for example, a particulate droplet, a tear-shaped droplet, and a viscous/thready droplet that forms a thread tail, without any limitation thereto. The "fluid" may be made of any material as long as a fluid ejecting apparatus can eject it.

The liquid may be any substance as long as it is in a liquid phase. It may have high viscosity or low viscosity. It may be sol or gel water. Alternatively, it may be fluid that includes, without any limitation thereto, inorganic solvent, organic solvent, solution, liquid resin, and liquid metal (e.g., metal melt). The "fluid" is not limited to liquid as a state of a substance. It encompasses a liquid/liquefied matter/material that is made as a result of dissolution, dispersion, or mixture of particles of a functional material made of a solid such as pigment, metal particles, or the like into/with a solvent, though not limited thereto. Ink described in the foregoing exemplary embodiment is a typical example of the fluid. The term "ink" encompasses various types of ink having various fluid compositions such as popular water-based ink, oil-based ink, gel ink, hot melt ink, or the like.

Examples of various fluid ejecting apparatuses are: an apparatus that ejects fluid in which, for example, a material such as an electrode material, a color material, or the like that is used in the production of a liquid crystal display device, an organic EL (electroluminescence) display device, a surface/plane emission display device, a color filter, or the like is dispersed or dissolved, an apparatus that ejects a living organic material that is used for production of biochips, an apparatus that is used as a high precision pipette and ejects fluid as a sample, a textile printing apparatus, a micro dispenser, and the like.

In addition, the invention is applicable to a fluid ejecting apparatus that ejects, with high precision, lubricating oil onto a precision instrument and equipment including but not limited to a watch and a camera. Moreover, the invention is applicable to a fluid ejecting apparatus that ejects fluid of a transparent resin such as an ultraviolet ray curing resin or the like onto a substrate so as to form a micro hemispherical lens (optical lens) that is used in an optical communication element or the like. Furthermore, the invention is applicable to a fluid ejecting apparatus that ejects an etchant such as acid or alkali that is used for the etching of a substrate or the like.

What is claimed is:

1. A fluid ejecting apparatus comprising:

a fluid ejecting head that has an ejection face in which a plurality of nozzles for ejecting fluid is formed, the ejection face being in an inclined state with respect to a horizontal plane; and a cap member that receives the fluid discharged from the fluid ejecting head, the cap member including a first wall parallel to a plane of the ejection face;

a second wall integrally attached to the first wall and perpendicular to the first wall and ejection face;

a third wall integrally attached to the first wall, wherein the third wall is perpendicular to the first wall and ejection face and is parallel to the second wall;

a holding portion that has a rim portion for holding an absorbing member that absorbs the fluid discharged from the fluid ejecting head, a fluid reservoir, integrally attached to the holding portion, that has a space for containing the fluid discharged from the fluid ejecting head, wherein the space is located below the absorbing member, in a direction of gravitational force, and adjoins the absorbing member, an air communication port that is formed in the second wall and the rim portion and that is located above the absorbing member in the direction of gravitational force, wherein the air communication port comprises a straight passageway that is parallel with the first wall and the plane of the ejection face;

a suction port that is formed in the third wall and that is below the space in a direction of gravitational force; and wherein the suction port comprises a straight passageway that is parallel with the first wall and the plane of the ejection face.

2. The fluid ejecting apparatus according to claim 1, wherein the air communication port is configured to be able to make the absorbing member and the fluid reservoir in communication with the outside therethrough.

3. The fluid ejecting apparatus according to claim 1, wherein the inclined state includes a first state, which is a state in which the ejection face is perpendicular to the horizontal plane.

4. The fluid ejecting apparatus according to claim 1, wherein the inclined state includes a second state, which is a state in which the ejection face is inclined with respect to the horizontal plane with a predetermined angle formed by the ejection face and the horizontal plane.

* * * * *